United States Patent [19]

Sung et al.

[11] Patent Number: 4,853,501

[45] Date of Patent: Aug. 1, 1989

[54] POWER CONTROL DEVICE FOR MICROWAVE OVEN

[75] Inventors: Yuhn K. Sung, Kyungkido; Yoo E. Bong, Seoul, both of Rep. of Korea

[73] Assignee: Sam Sung Electronic Co. Ltd., Suwonsi, Rep. of Korea

[21] Appl. No.: 119,929

[22] Filed: Nov. 13, 1987

[30] Foreign Application Priority Data

Nov. 14, 1986 [KR] Rep. of Korea ..... 198647760

[51] Int. Cl.[4] ..... H61H 43/10

[52] U.S. Cl. ..... 200/38 FA

[58] Field of Search ..... 200/35 R, 38 R, 38 A, 200/38 F, 38 D, 38 DC, 153 T, 332, 38 FA; 219/10.55 B, 10.55 C

[56] References Cited

U.S. PATENT DOCUMENTS 2,937,247 5/1960 Laviana et al. ..... 200/38 A 3,179,758 4/1965 Trock ..... 200/38 D 3,881,075 4/1975 Kitai ..... 200/38 A X

*Primary Examiner*—J. R. Scott

*Attorney, Agent, or Firm*—Saidman, Sterne, Kessler & Goldstein

[57] ABSTRACT

The present invention relates to a device for power control to the magnetron in a microwave oven. The two timer switches conventionally used for controlling the power to the magnetron may be replaced by a configuration in which only one timer switch is used. The timer switch formerly used for switching between high power mode and low power mode is replaced by a microswitch with accompanying driving mechanism. The microswitch is controlled through action of a continuous pressing element, cam, and a band spring so that the cooking modes can be switched between high and low power mode in a manner equivalent to that of known timer switches.

6 Claims, 3 Drawing Sheets

POWER CONTROL DEVICE FOR MICROWAVE OVEN

BACKGROUND OF THE INVENTION

1. Field of the Invention

The present invention relates to devices for switching power in microwave ovens. More specifically, the invention relates to devices for controlling the output power of the microwave oven's magnetron which involves a timer switch device.

2. Related Art

Generally, microwave ovens are required to change their operational modes because the necessary cooking period and the nature of the microwave cooking should be made different according to the properties of the food to be cooked. In known systems, separate timer switches having on and off functions as well as intermittent on and off states of electric power supplies for controlling the magnetron output power have been employed.

When either the "high position" (which is traditionally the condition of continuous electric power) or the "low position" (which is traditionally the condition of intermittent electric power) for each predetermined period are required, two large and expensive timer switches have been used for controlling the magnetron's output power. The use of two timer switches has the disadvantages of occupying a large volume of space, decreasing cost-effectiveness due to the complexity of the structure, and increasing manufacturing cost.

SUMMARY OF THE INVENTION

The present invention overcomes the disadvantages of known systems, in that it provides a device for output power control which is simple and compact. The invention envisions the replacement of one of the two timer switches with a microswitch, a continuous pressing element, and a cam. Embodiments of the present invention occupy a smaller volume, and are lower in cost than known systems.

BRIEF DESCRIPTION OF THE DRAWINGS

The invention is best understood by reading the following detailed description with reference to the accompanying drawings, in which like reference numbers refer to like elements throughout, and in which.

DETAILED DESCRIPTION OF THE PREFERRED EMBODIMENTS

Briefly, the advantages of the present invention may be attained in a preferred embodiment by arranging a microswitch having a microswitch lever fixed beneath it so that an intermittent pressing arm projecting from the bottom of the timer switch toward the microswitch lever is situated so as to intermittently press down on the microswitch lever. A continuous pressing element which is fixed slidably on the surface of a panel and which has a rectangular opening moves for either pressing or releasing the microswitch lever which is inserted within the rectangular opening. A cam with a protruding portion and which has a control shaft through a shaft aperture on the panel drives a driving surface of the continuous pressing element. The cam with the protruding portion may be turned clockwise or counterclockwise through means of the cam control shaft so as to select either a "high position" or a "low position." A limiting pin fixed on the cam travels in an arc-shaped aperture in the panel. A band spring is disposed under the cam, and presses upwardly against the cam for stable holding and switching operation throughout a user's turning of the cam control shaft to the desired mode.

Figure 2B:
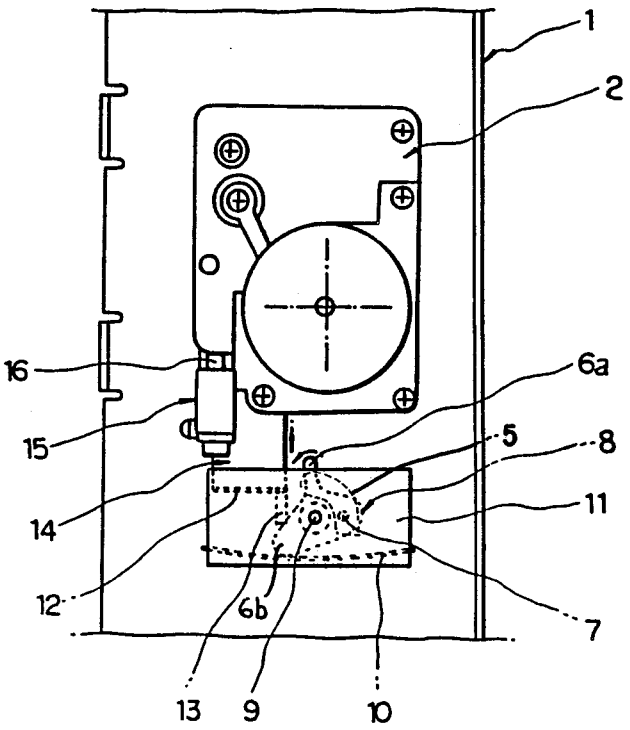
FIG. 2(A) and FIG. 2(B) are front views showing the high and low operating modes, respectively, according to the preferred embodiment of the present invention.
Figure 2A:
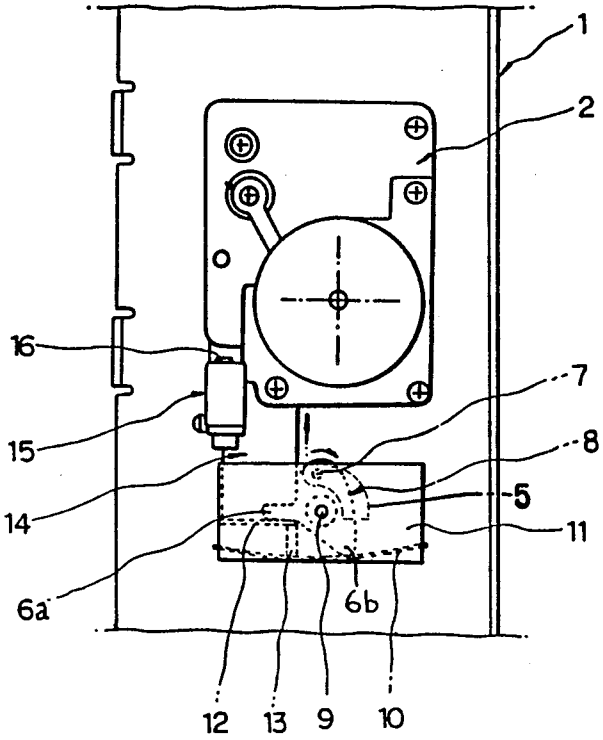
Figure 3:
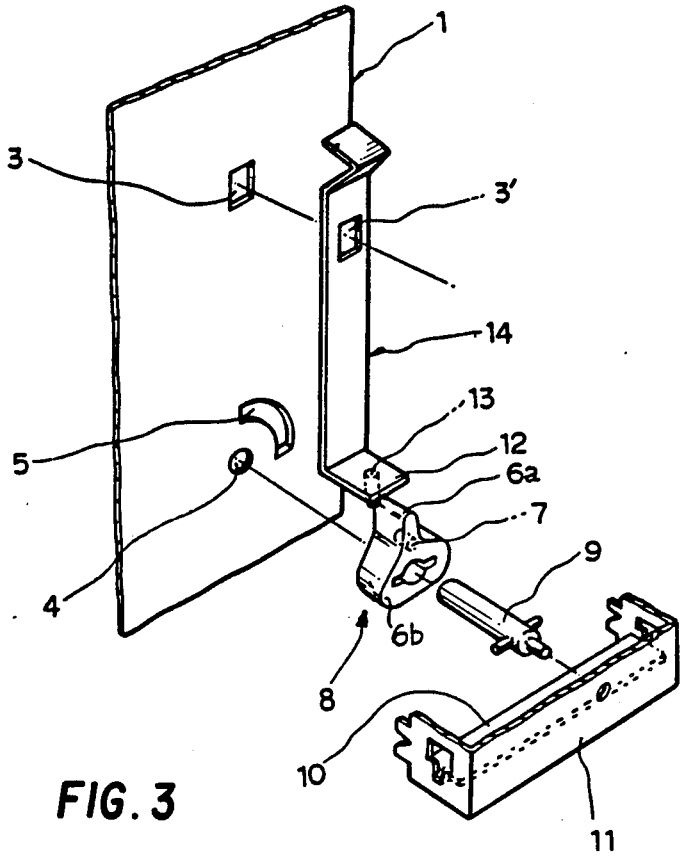
FIG. 3 is an exploded perspective view illustrating certain elements of the preferred embodiment of the present invention.

Referring especially to FIG. 3 (but also, in part, to FIGS. 1–2), a fixed rectangular opening 3, a shaft aperture 4, and an arc-shaped aperture 5 are perforated in panel 1 as shown, in the preferred embodiment. Cam 8 has cam control shaft 9 inserted securely through its center portion. Cam 8 has first and second protruding portions 6*a* and 6*b*, and has a limiting pin 7 projecting from the surface toward panel 1. The cam is rotatably fixed onto the panel 1 by means of cam control shaft 9 inserted through shaft aperture 4. Cam limiting pin 7 engages within the arc-shaped aperture 5. A band spring 10 is disposed under the cam 8, and is supported within a cover 11 which is in turn fixed to the panel 1. The band spring 10 presses upwardly against the bottom surface of the cam 8. Continuous pressing element 14 has a rectangular opening 3' perforated in it, as well as a driving surface 12 which, in the preferred embodiment, is at an end of the continuous pressing element 14 substantially opposite to that of the rectangular opening 3'. A contact member 13 is advantageously affixed to the driving surface 12 and projects toward bandspring 10. The continuous pressing element 14 is slidably fixed to panel 1.

Figure 1B:
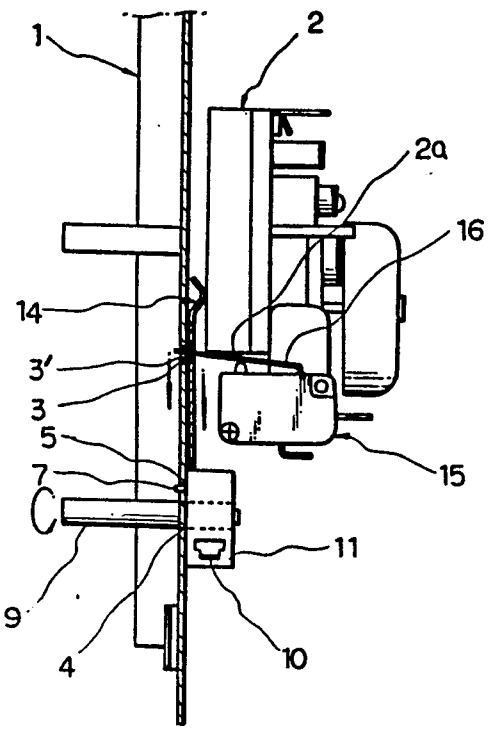
FIG. 1(A) and FIG. 1(B) are side views showing the high and low operating modes, respectively, according to the preferred embodiment of the present invention.
Figure 1A:
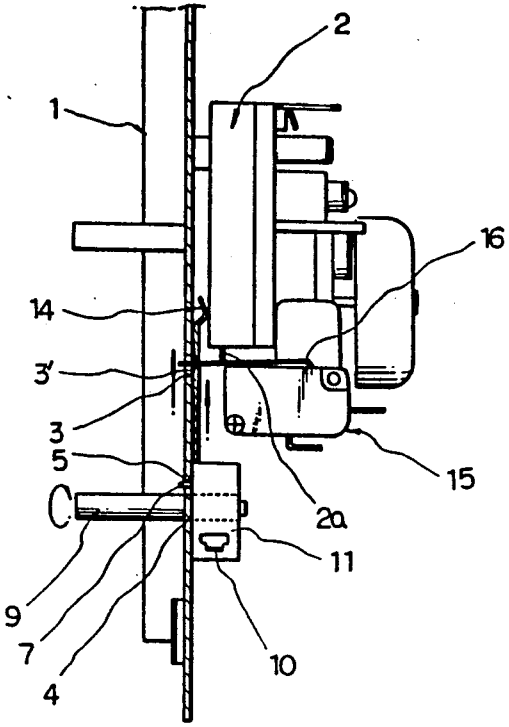

A microswitch 15 has a microswitch lever 16 which, in the preferred embodiment illustrated in FIGS. 1 and 2, is fixed beneath the standard timer switch 2, and extends through the rectangular opening 3' on the continuous pressing element 14 so as to penetrate rectangular opening 3 on panel 1. This arrangement of elements allows the turning of cam 8, pressing downward on driving surface 12, to move continuous pressing element 14 so that the microswitch lever 16 may be pressed down with the upper edge of rectangular opening 3', as shown in FIGS. 1(A) and 2(A).

The operation of the preferred embodiment may be described in greater detail as follows.

When foods are to be cooked using microwave ovens, the output power of the microwave oven's magnetron must be selectably controlled according to the condition and properties of the foods to be cooked. Usually, the two modes of operation are "high position" mode and "low position" mode. The "high position" mode usually means that the output power of the magnetron is continually "on" due to continuous electric power supply thereto. On the other hand, the "low position" mode implies the output power of the magnetron is on only intermittently.

When the "low position" is desired (based on the properties of the foods which are to be cooked, such as whether or not they are frozen or refrigerated), the microswitch 15 is turned off by turning the cam control shaft 9 clockwise, so that the continuous pressing element's rectangular opening 3' does not force microswitch lever 16 downward into the "on" position. Timer switch 2 thus controls the intermittent switching of the mciroswitch lever 16 through periodic extension and withdrawal of intermittent pressing element 2a (FIG. 4).

Figure 4:
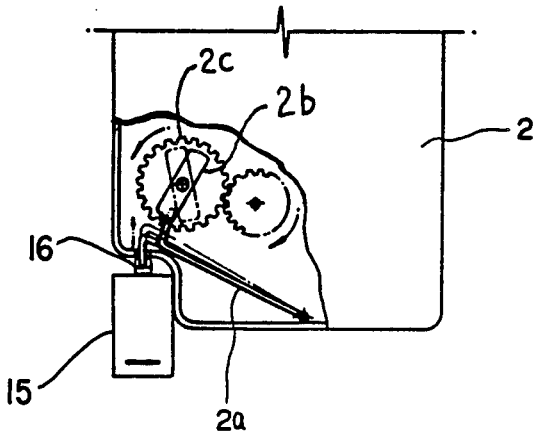
FIG. 4 PRIOR ART
FIG. 4 is a front view of a conventional timer switch, partially cut away for illustration, showing the mechanism for intermittent on-off operation embodied by a cam attached to a driving gear.

FIG. 4 illustrates a timer switch which may be chosen to be on which is known in the art. Briefly, all that is necessary of the timer switch is that it press down intermittently on a microswitch lever 16 (FIGS. 1 and 2). This may be achieved through use of a set of gears (two of which are indicated in FIG. 4 as element 2c and 2d) to which is attached a cam 2b. Cam 2b rotates with its associated driving gear 2c so as to cause downward displacement of intermittent pressing arm 2a. Intermittent pressing arm 2a presses against microswitch lever 16 intermittently so as to intermittently turn microswitch 15 on and off.

When the "high position" mode of the microwave oven is desired to be entered, such as when the foods to be cooked are not frozen, then the cooking needs to be accomplished through continuous magnetron output for a desired period. Therefore, continuous electric power must be supplied to the microwave oven's magnetron.

To establish the "high position" cooking mode, the cam 8 may be turned counterclockwise, as shown most clearly in going from the position in FIG. 2(B) to FIG. 2(A). Cam control shaft 9 may be operated by a user to turn cam 8 until the cam's rotational movement is limited by limiting pin 7 which reaches the end of the arc-shaped aperture 5 in the panel 1. As the cam rotates about the shaft aperture 4 through which cam control shaft 9 has been inserted, the protruding portion 6 of the cam presses down on the driving surface 12 of the continuous pressing element 14. As a result of the pressure exerted by protruding portion 6a on the driving surface 12, the continuous pressing element 14 is displaced downwardly until the contact member 13 contacts band spring 10 within the cover 11. The rectangular opening 3' in the continuous pressing element 14 draws downward microswitch lever 16 which extends through the rectangular opening 3'. The microswitch 15 is thus turned to the "on" state by the downward pressing of the microswitch lever 16.

Thus, in the "high position" mode, in which continuous electric power supply is provided to the magnetron, continuous cooking of foods is accomplished which would not otherwise have occurred solely through the use of a single timer switch 2.

When transferring from the "high position" mode back to the "low position" mode, the user need only turn cam control shaft 9 clockwise, as most clearly shown in going from the position in FIG. 2(A) to that in FIG. 2(B). The displacement of the continuous pressing element 14 is determined at least in part according to the elasticity of bandspring 10, as well as the action of the protruding portion 6a of cam 8. The continuous pressing element 14 may be kept moving upwardly by the elasticity of bandspring 10 acting through the contact member 13 to the point where cam 8 is rotated completely to a position where the second protruding portion 6b of the cam pushes upwardly against the contact member 13 on the driving surface 12. Eventually, the bottom surface of the cam 8 contacts the surface of bandspring 10, as shown in FIG. 2(B), so that the ultimate displacement of the continuous pressing element 14 away from the bandspring 10 is achieved and stabilized. The pressure formerly impressed upon microswitch lever 16 by the upper portion of rectangular portion 3' is released so that the microswitch 15 is placed in its off state. When the continuous pressing element 14 is in this position, power is controlled through operation of the timer switch 2 alone, through the action of its intermittent pressing lever 2a.

In summary, in the "high position" mode, timer switch 2 and microswitch 15 operate to provide continuous electric power to the magnetron. In the "low position" mode, the microswitch 15 is in its on or off states only when the timer switch 2 so provides solely according to its internal timing features.

In this manner, the present invention overcomes the limitation of known switching systems through elimination of the need for two costly and space-consuming timer switches. One of the two conventional timer switches may be replaced by a microswitch 15 which is smaller and less expensive so that, despite achieving substantially similar function as the conventional switching configuration, reduction in size and cost of the components, and subsequent increased productivity, may be achieved.

Whereas various details of a preferred embodiment of the present invention have been presented above, it is to be understood that the description has been provided by way of example, and not limitation. For example, the placement of a timer switch "above" a microswitch is not an absolute necessity for the proper functioning of the invention, but is merely exemplary of the relative orientations possible. Thus, the breadth and scope of the present invention should be defined not in accordance with the above detailed description, but should be limited only by the following claims and their equivalents.

What is claimed is:

1. A power control device for a microwave oven equipped with a panel for a timer switch, the timer switch having an intermittent pressing arm extending from it, the power control device comprising:

(a) a microswitch, attached to the panel, said microswitch havng a microswitch lever extending from it so that the intermittent pressing arm of the timer switch intermittently physically presses on said microswitch lever during a "low mode" of operation of the microwave oven, said microswitch lever turning on said microswitch when said microswitch lever is pressed and turning off said microswitch when said microswitch lever is not pressed, thereby controlling power to the microwave oven;

(b) a continuous pressing element, fixed movably on the panel, for selectively (1) pressing against said microswitch lever during a "high mode" of operation of the microwave oven, or (2) releasing said microswitch lever during said low mode so that the intermittent pressing arm controls position of said microswitch lever;

(c) a cam assembly, comprising (1) a cam with a first protruding portion for pressing against a driving surface of said continuous pressing element;

(2) a control shaft penetrating said cam, for turning said cam so as to switch selectively between a "high position" corresponding to said high mode and a "low position" corresponding to said low mode; and (3) a limiting pin extending from said cam to fit into an arc-shaped aperture in the panel for travelling within said arc-shaped aperture as said cam rotates, said limiting pin physically contacting respective ends of said arc-shaped aperture when said cam is in said high and low positions; and (d) a band spring for pressing against said cam for stable holding and switching operation throughout the turning of said control shaft.

2. The power control device of claim 1, wherein:

said continuous pressing element comprises a rectangular opening having an edge for pressing said microswitch lever projecting through said rectangular opening when said cam is set in said "high position".

3. The power control device of claim 2, wherein said panel includes:

a fixed rectangular opening disposed substantially adjacent said rectangular opening on said continuous pressing element so that said microswitch lever penetrates both said rectangular openings; and a shaft aperture for receiving said control shaft.

4. The power control device of claim 1, wherein said continuous pressing element further comprises:

a physical contact member extending from said driving surface toward said band spring, which physical contact member is pushed in a first direction through physical contact with said band spring when said cam is rotated so as to move said continuous pressing element in said first direction, so that said continuous pressing element releases said microswitch lever during sad low mode of operation.

5. The power control device of claim 1, wherein:

said cam is connected to the panel via said control shaft by virtue of said control shaft passing through a shaft aperture in the panel; and said limiting pin passes through said arc-shaped aperture in the panel.

6. The power control device of claim 5, wherein:

said cam presses against a driving surface of said continuous pressing element so that rotation of said cam causes an edge of said continuous pressing element to press against said microswitch lever during said high mode, and releases said microswitch lever during said low mode.

* * * * *